United States Patent [19]

Kaetterhenry

[11] 4,018,136

[45] Apr. 19, 1977

[54] HYDRAULIC APPARATUS FOR CONTROLLING MOVEMENT OF A MEMBER UNDER LOADING

[76] Inventor: Lorell D. Kaetterhenry, Rte. No. 1, Hartford, Wis. 53027

[22] Filed: Dec. 18, 1974

[21] Appl. No.: 533,976

[52] U.S. Cl. ..... 91/420; 91/449

[51] Int. Cl.[2] ..... F15B 11/08; F15B 13/042

[58] Field of Search ..... 91/420, DIG. 2, 449; 137/599, DIG. 8; 251/63, 117

[56] References Cited

UNITED STATES PATENTS

| | | | |
|---|---|---|---|
| 1,117,993 | 11/1914 | Frazier | 137/DIG. 8 |
| 1,171,695 | 2/1916 | Brady | 137/DIG. 8 |
| 1,883,240 | 10/1932 | Phelan | 251/117 |
| 1,964,196 | 6/1934 | Cuttat | 91/449 X |
| 2,255,787 | 9/1941 | Kendrick | 91/420 X |
| 2,538,806 | 1/1951 | St. Clair | 251/117 X |
| 2,701,704 | 2/1955 | Lawrence | 251/63 X |
| 2,893,082 | 7/1959 | Hodler | 91/420 X |
| 2,926,634 | 3/1960 | Falendysz et al. | 91/443 X |
| 3,018,902 | 1/1962 | Minty | 91/420 X |
| 3,675,891 | 7/1972 | Reynolds et al. | 251/117 |
| 3,700,396 | 10/1972 | Adams | 91/449 |
| 3,835,751 | 9/1974 | Cowan | 91/420 |

FOREIGN PATENTS OR APPLICATIONS

| | | | |
|---|---|---|---|
| 72,936 | 3/1944 | Czechoslovakia | 91/420 |
| 1,248,011 | 10/1960 | France | 91/443 |
| 1,036,598 | 8/1958 | Germany | 91/420 |

*Primary Examiner*—Irwin C. Cohen
*Attorney, Agent, or Firm*—Michael, Best & Friedrich

[57] ABSTRACT

Disclosed herein is an apparatus including a member mounted on a frame and biased for movement in one direction, a hydraulic cylinder-piston assembly connected between the frame and the member and including a piston and a cylinder which houses the piston and includes opposed ends, together with a first fluid line extending from the one of the cylinder ends toward which the piston moves incident to movement of the member in the one direction, a second fluid line extending from the other of the cylinder ends, a control valve operatively connected to a source of pressure fluid and to the first and second fluid lines and including selectively operable means for supplying and draining fluid from the cylinder, a first safety valve in the first fluid line and first hydraulic means operatively connected to the first valve member for displacing the first valve member from a flow permitting position and second hydraulic means operatively connected to the second valve member for displacing the second valve member from a duct closing position.

1 Claim, 2 Drawing Figures

HYDRAULIC APPARATUS FOR CONTROLLING MOVEMENT OF A MEMBER UNDER LOADING

BACKGROUND OF THE INVENTION

The invention relates generally to construction equipment and to hydraulically operated safety or control valves. More particularly, the invention relates to construction apparatus including a member which is biased by gravity or by loading for movement in one direction and which, accordingly, has a tendancy to move percipitously in the one direction. Such percipitous movement has, in the past, been a concern from the safety viewpoint.

Attention is directed to the Martin U.S. Pat. No. 3,247,867 which issued Apr. 26, 1966, and to the Bianchetta U.S. Pat. No. 3,523,490 which issued Aug. 11, 1970.

SUMMARY OF THE INVENTION

In accordance with one aspect of the invention, there is provided a first safety valve comprising a body including therein a main bore having therein a restriction, a duct communicating with the main bore in by-passing relation to the restriction and including therein a valve seat, a valve member movable relative to a position in engagement with the valve seat so as to close the duct, means biasing the valve member to the duct closing position, and means for displacing the valve member from the duct closing position against the action of the biasing means.

In accordance with an embodiment of the invention, the first safety valve is employed in conjunction with apparatus including a supporting frame, a member mounted on the frame for biased movement in one direction, a hydraulic cylinder-piston assembly connected between the frame and the member and including a piston and a cylinder which houses the piston and includes opposed ends, a first fluid line extending from the one of the cylinder ends toward which the piston moves incident to movement of the member in the one direction, a second fluid line extending from the other of the cylinder ends, a source of pressure fluid, and a control valve operatively connected to the source of pressure fluid and to the first and second fluid lines and including selectively operable means for supplying fluid to the one cylinder end and draining fluid from the other cylinder end and for supplying fluid to the other cylinder end and draining fluid from the one cylinder end, and wherein the first safety valve is located in the first fluid line and further including a pressure fluid line communicating between the other cylinder end and the valve member displacing means.

In accordance with another aspect of the invention, there is provided a second safety valve comprising a body including therein a main bore and a cross bore extending transversely of and communicating with the main bore, a valve member movable in the cross bore between a position blocking the main bore and a position permitting flow through the main bore, means biasing the valve member toward the flow permitting position, and means communicating with the cross bore for displacing the valve member to the flow blocking position against the action of the biasing means.

In accordance with an embodiment of the invention, the second safety valve is employed in conjunction with apparatus including a supporting frame, a member mounted on the frame for biased movement in one direction, a hydraulic cylinder-piston assembly connected between the frame and the member and including a piston and a cylinder which houses the piston and includes opposed ends, a first fluid line extending from the one of the cylinder ends toward which the piston moves incident to movement of the member in the one direction, a second fluid line extending from the other of the cylinder ends, a source of pressure fluid, and a control valve operatively connected to the source of pressure fluid and to the first and second fluid lines and including selectively operable means for supplying fluid to the one cylinder end and draining fluid from the other cylinder end and for supplying fluid to the other cylinder end and draining fluid from the one cylinder end, and wherein the second safety valve is located in the first fluid line, and further including a pressure fluid line communicating between the other cylinder end and the valve member displacing means.

Also in accordance with the invention there is provided apparatus including a supporting frame, a member mounted on the frame for biased movement in one direction, a hydraulic cylinder-piston assembly connected between the frame and the member and including a piston and a cylinder which houses the piston and includes opposed ends, together with a first fluid line extending from the one of the cylinder ends toward which the piston moves incident to movement of the member in the one direction, a second fluid line extending from the other of the cylinder ends, a source of pressure fluid, a control valve operatively connected to the source of pressure fluid and to the first and second fluid lines and including selectively operable means for supplying fluid to the one cylinder end and draining fluid from the other cylinder end and for supplying fluid to the other cylinder end and draining fluid from the one cylinder end, a first safety valve in the first fluid line and comprising a first body including therein a first main bore, and a cross bore extending transversely of and communicating with the first main bore, a first valve member movable in the cross bore between a position blocking the first main bore and a position permitting flow through the first main bore, means biasing the first valve member toward the flow permitting position, and first hydraulic means operatively connected to the first valve member for displacing the first valve member from the flow permitting position against the action of the means biasing the first valve member and including a first conduit communicating with the other cylinder end, and a second safety valve in the first fluid line and comprising a second body including therein a second main bore having therein a restriction, a duct in the second body communicating with the second main bore in by-passing relation to the restriction and including therein a valve seat, a second valve member movable relative to a position in engagement with the valve seat so as to close the duct, means biasing the second valve member toward the duct closing position, and second hydraulic means operatively connected to the second valve member for displacing the second valve member from the duct closing position against the action of the means biasing the second valve member and including a second conduit communicating with the other cylinder end.

Other features and aspects of the embodiments of the invention will become known by reference to the following drawings, general description, and claims.

IN THE DRAWINGS

Figure 1:
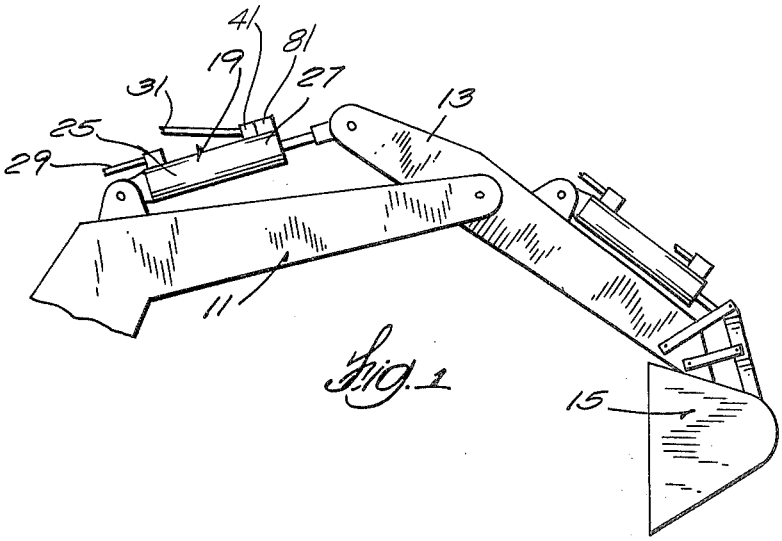
FIG. 1 is a fragmentary view of an apparatus embodying various of the features of the invention.
Figure 2:
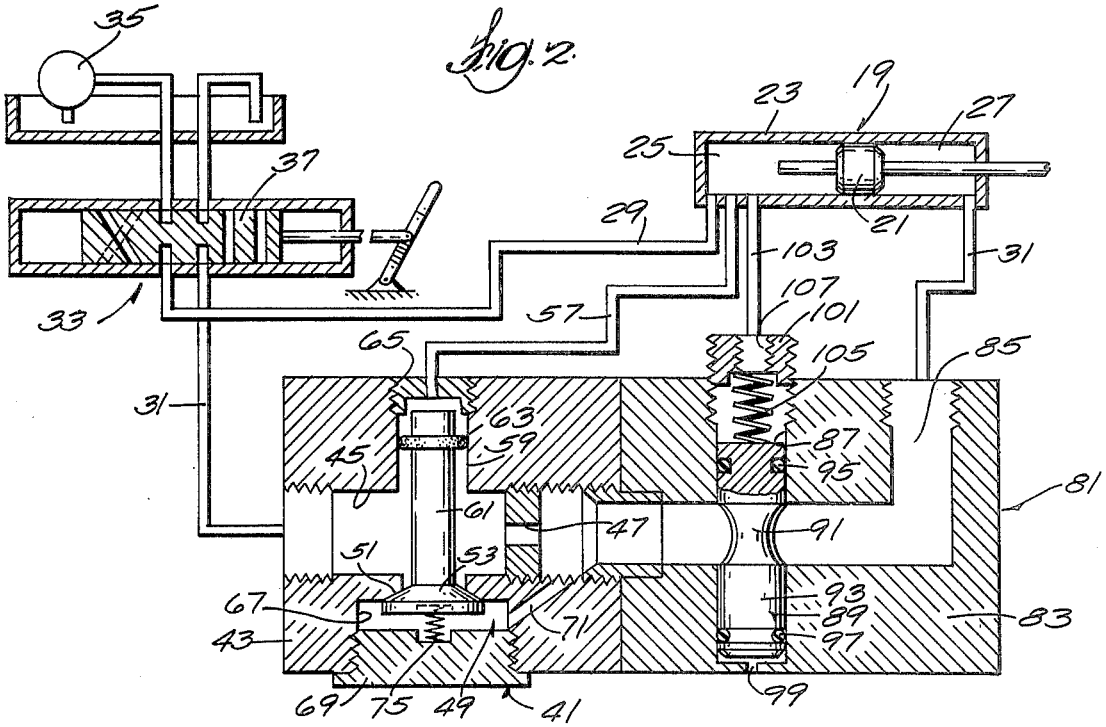
FIG. 2 is a schematic view, partially in section, of a portion of the apparatus shown in FIG. 1.

Before explaining the embodiment of the invention shown in the drawings, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

GENERAL DESCRIPTION

Shown generally in the drawings is a supporting frame or member 11 which can, for instance, be the boom for any number of vehicles, such as, for instance, a back hoe or the like. Movably mounted on the supporting frame 11 is a member 13 which is biased for movement in one direction. In the illustrated construction, the member 13 is pivotally mounted from the supporting frame 11 and is gravitationally biased in a clockwise direction.

As illustrated, the outer end of the member 13 can pivotally or otherwise support a work piece 15, as for instance, the illustrated dipper or fork structure or other work piece.

Connected between the member 13 and the supporting frame 11 is a hydraulic cylinder piston assembly 19 including a piston 21 and a cylinder 23 which houses the piston 21 and which has opposed inner and outer ends 25 and 27.

Connected to the ends 25 and 27 of the cylinder are respective first and second fluid pressure lines 29 and 31 which, in turn, are connected to a control valve 33 which also communicates with a suitable source 35 of pressure fluid. The control valve 33 includes means including a shiftable valve member 37, shown schematically, for selectively supplying pressure fluid to the cylinder 23 through the fluid line 29 and draining of pressure fluid from the cylinder 23 through the other fluid line 31, and vice versa.

As thus far disclosed, the construction is conventional and, when the control valve 33 is arranged to supply pressure fluid to the cylinder end 25 and to drain fluid from the cylinder end 27, the member 13 can move precipitously in the clockwise direction due to the bias of gravity or the load supported by the work piece 15.

In accordance with one aspect of the invention, there is provided in the pressure fluid line 31 a safety or control valve 41 which includes a housing or main body 43 having therein a central or main bore 45 which forms part of the pressure fluid line 31 and which includes a restriction 47 limiting pressure fluid flow from the cylinder end 27 in such manner as to meter the flow of pressure fluid from the cylinder end 27 and thereby prevent precipitous movement of the member 13 in the clockwise direction.

The safety valve 41 also includes means for by-passing the restriction 47 whenever the cylinder end 25 is subject to fluid under normal operating pressure and thereby to permit controlled clockwise movement of the member 13 at an increased rate. While other specific arrangements could be employed, in the preferred and illustrated construction, the by-pass means comprises a by-pass duct 49 communicating at its end with the main bore 45 in by-passing relation to the restriction 47, and, intermediate the ends of the duct 49, including a valve seat 51, together with a valve member 53 movable relative to a duct closing position in engagement with the valve seat 51, and means biasing the valve member 53 toward the closed position.

Also included in the safety valve 41 is means for displacing the valve member 53 against the action of the biasing means so as to open the duct and permit relatively unrestricted pressure fluid flow in the fluid line. In the illustrated construction, such valve member displacing means is hydraulically operated and comprises a pressure fluid line or conduit 57 communicating with the cylinder end 25 and operable to apply the available pressure in the cylinder end 25 to the valve member 53 so as to displace the valve member 53 from the duct closing position.

More specifically, in the illustrated construction, the main body 43 is provided with a cross bore 59 which receives a valve stem 61 extending from the valve member 53. The valve stem 61 is provided with one or more O-rings 63 and acts, in relation to the cross bore 59, in the same manner as a piston in a cylinder. The outer end of the cross bore 59 is provided with a fitting 65 to which the conduit 57 is connected. At its other end, the cross bore 59 is provided with a counter bore 67 into which the valve member 53 moves during valve member movement from the duct closing position. In turn, the counter bore 67 is closed by a threaded plug or cover 69.

As can be seen from the drawings, the by-pass duct 49 comprises part of the cross bore 59, and part of the counter bore 67, and a connecting bore 71.

The biasing means comprises a helical spring 75 acting between the cover 69 and the valve member 53 and is of such strength as to be overcome when pressure fluid at full normal pressure is applied at the end of the valve stem 61. However, in the absence of full fluid pressure, the spring 75 is effective to maintain the valve member 53 in duct closing position.

Thus, in operation, whenever the member 13 attempts movement in the clockwise direction at a rate which could result in less than full fluid pressure in the cylinder end 25, such lack of full fluid pressure permits the spring 75 to close the by-pass duct 49 so as to limit fluid flow from the cylinder end 27 and thereby restrain clockwise movement of the member 13. However, when the cylinder end 25 is fully pressurized by pressure fluid, such pressure will also be applied through the conduit 57 to displace the valve member 53 from the duct closing position. Opening of the by-pass duct 49 serves to permit increased fluid flow from the cylinder end 27. However, should fluid flow from the cylinder end 27 become excessive, i.e., be greater than the supply of fluid to the cylinder end 25, the pressure in the cylinder end 25 will fall below normal full line pressure, causing the valve member 53 to close under the action of the spring 75, thereby restricting clockwise movement of the member 13.

In accordance with another aspect of the invention, there is provided another safety or control valve 81 arranged so as to prevent movement of the member 13 in the clockwise direction in the event, as for instance, of a failure in the fluid pressure line 31 leading from the control valve 33 to the cylinder end 27. In this regard, it is noted that the fluid pressure line 31 is pressurized as a result of any load in the work piece 15. The safety valve 81 is preferably located, as shown in FIG. 1, in substantially direct communication with the cylinder end 27 and is operable, in response to such clockwise movement of the member 13 as would be effective to create a predetermined low pressure level in the other cylinder end 25, so as to close off or seal the cylinder end 27, thereby preventing further fluid flow from the cylinder end 27 and thereby arresting clockwise movement of the member 13.

More particularly, the safety valve 81 comprises a housing or main body 83 which is preferably mounted on the cylinder 23 adjacent the end 27 thereof and which includes a central or main bore 85 forming a part of the fluid pressure line 31 and having one end more or less in direct communication with the cylinder end 27. Such direct communication reduces the possibility of the failure of the fluid pressure line 31 between the safety valve 81 and the cylinder end 27.

The other end of the central bore 85 communicates through the fluid pressure line 31 with the control valve 33 and preferably, as already indicated, communicates through the safety valve 41.

Also included in the housing 81 is a cross bore 87 which contains a valve member 89 movable between a closed position blocking pressure fluid flow through the main bore 85 and an open position permitting pressure fluid flow through the main bore 85. In this last regard, the cross bore 87 has at least as large a diameter as the main bore 85 and the valve member 89 includes a neck portion 91 of reduced size so that, when the valve member 89 is in the open position, the neck portion 91 is located in the main bore 85 to permit pressure fluid through the main bore 85. In addition, the valve member 89 includes, adjacent to the neck portion 91, a blocking portion 93 which, when the valve member 89 is in the closed position, extends completely across the main bore 85 to prevent pressure fluid flow therethrough. Above and below the adjacent neck and blocking portions 91 and 93, the valve member is provided with respective O-rings 95 and 97 preventing leakage between the valve member 89 and the cross bore 87.

The end of the cross bore 87 adjacent to the blocking portion 93 of the valve member 89 is provided with a vent hole 99, while the end of the cross bore 87 adjacent to the neck portion 91 has connected thereto a fitting 101 which communicates through a fluid pressure line or conduit 103 with the cylinder end 25 and with the interior of the cross bore 87.

Means are provided for biasing the valve member 89 away from the fitting toward the open position with the neck portion 91 in alignment with the main bore 85. While various arrangements can be employed, in the illustrated construction, such means comprises a helical spring 105 which is located in the cross bore 87 and which, at its ends, bears against the end of the valve member 89 adjacent the neck portion 91 and against an interior shoulder 107 on the fitting 101.

In operation, when the pressure in the cylinder end 25 reaches or drops below a predetermined low pressure level, such low pressure is communicated through the conduit 103 to the end of the valve member 89 and is effective, against the action of the spring 105, to displace the valve member 89 to the bore closing position, thus preventing flow through the valve 81 and thereby stopping further movement of the member 13 in the clockwise direction under the influence of gravity or any load carried thereby.

When there is a relatively high pressure in the cylinder end 25, i.e., normal full line pressure, the valve member 53 of the safety valve 41 is opened against the action of the spring 75 to provide unrestricted flow through the safety valve 41 and the valve member 89 of the safety valve 81 is also in the open position under the action of the fluid pressure and the spring 105. However, should the pressure in the cylinder end 25 fall below the relatively high full line pressure, the spring 75 will be effective to close the valve member 53 against the seat 51 so as to restrict pressure fluid flow through the fluid line 31 and limit the rate of clockwise movement of the member 13.

In the event the clockwise movement of the member 13 is sufficiently rapid that the pressure in the cylinder end 25 decreases to a relatively low pressure level, as for instance, in the event of a failure in the fluid pressure line 31 permitting discharge of fluid from the cylinder end 25, the resulting low pressure acts against the spring 105 to displace the valve member 89 to the closed position so as to prevent further fluid flow through the safety valve 81 and thereby prevent further fluid flow from the cylinder end 27 and thereby also stop clockwise movement of the member 13.

It is preferred that the safety valve 41 be located adjacent to the safety valve 81 and mounted on the end 27 of the cylinder 23 as shown in FIG. 1. While it is preferred that safety valves 41 and 81 be employed together, at least some of the advantages of the invention can be obtained when either one of the safety valves 41 and 81 is used independently of the other. In addition, if desired the safety valves could both be incorporated in a single housing or could be bodily incorporated into the cylinder 23.

Various of the features of the invention are set forth in the following claims.

I claim:

1. Apparatus including a supporting frame, a member mounted on said frame for biased movement in one direction, a hydraulic cylinder-piston assembly connected between said frame and said member and including a piston and a cylinder which houses said piston and includes opposed ends, a first fluid line extending from the one of said cylinder ends toward which said piston moves incident to movement of said member in said one direction, a second fluid line extending from the other of said cylinder ends, a source of pressure fluid, a control valve operatively connected to said source of pressure fluid and to said first and second fluid lines and including selectively operable means for supplying fluid to said one cylinder end and draining fluid from said other cylinder end and for supplying fluid to said other cylinder end and draining fluid from said one cylinder end, a first safety valve in said first fluid line responsive to pressure less than atomspheric and comprising a first body including therein a first main bore, and a cross bore extending transversely of and communicating with said first main bore, a first valve member movable in said cross bore between a position blocking said first main bore and a position permitting flow through said first main bore, said valve member including a face against which pressure can be applied to displace said valve member relative to said positions, means biasing said first valve member toward said flow permitting position, and first hydraulic means operatively connected to said first valve member for displacing said first valve member from said flow permitting position against the action of said means biasing said first valve member and including a first conduit communicating with said valve member face and with said other cylinder end for transmitting said pressure less than atmospheric, and a second safety valve responsive to pressure greater than atmospheric in said first fluid line and comprising a second body including therein a second main bore having therein a restriction, a duct in said second body communicating with said second main bore in by-passing relation to said restriction and including therein a valve seat, a second valve member movable relative to a position in engagement with said valve seat so as to close said duct, said second valve member including a face against which pressure can be applied to displace said second valve member relative to said duct closing position, means biasing said second valve member toward said duct closing position, and second hydraulic means operatively connected to said second valve member for displacing said second valve member from said duct closing position against the action of said means biasing said second valve member and including a second conduit communicating said second valve member face with said other cylinder end.

* * * * *